US008246132B2

(12) United States Patent
Martinez et al.

(10) Patent No.: US 8,246,132 B2
(45) Date of Patent: Aug. 21, 2012

(54) IMAGE FORMING SYSTEMS AND METHODS THEREOF

(75) Inventors: Angel Martinez, Barcelona (ES); Mikel Zuza Irurueta, Barcelona (ES); Pere Esterri Pedra, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 355 days.

(21) Appl. No.: 12/703,332

(22) Filed: Feb. 10, 2010

(65) Prior Publication Data

US 2011/0193901 A1 Aug. 11, 2011

(51) Int. Cl.
*B41J 2/95* (2006.01)

(52) U.S. Cl. ..... 347/7; 347/19

(58) Field of Classification Search ..... 347/7, 19
See application file for complete search history.

(56) References Cited

U.S. PATENT DOCUMENTS 6,019,449 A * 2/2000 Bullock et al. ..... 347/14
6,151,039 A * 11/2000 Hmelar et al. ..... 347/7
6,454,381 B1 * 9/2002 Olsen et al. ..... 347/19
6,827,412 B2 * 12/2004 Inui et al. ..... 347/7
6,973,409 B1 * 12/2005 Shimizu et al. ..... 702/173
2002/0118236 A1 * 8/2002 Uetsuki ..... 347/7
2003/0071862 A1 * 4/2003 Tsukada et al. ..... 347/7
2009/0289971 A1 * 11/2009 Gilson et al. ..... 347/7

* cited by examiner

*Primary Examiner* — Julian Huffman
*Assistant Examiner* — Sharon A Polk

(57) ABSTRACT

A method to determine an amount of remaining fluid in a replaceable fluid supply unit includes determining a first estimated fluid volume of a first replaceable fluid supply unit in communication with a fluid ejector unit, determining a first correction factor corresponding to the first replaceable fluid supply unit in communication with the fluid ejector unit including at least a first volume ratio parameter corresponding to a ratio of a first nominal fluid volume of the first replaceable fluid supply unit and the first estimated fluid volume, determining an amount of fluid consumed from a second replaceable fluid supply unit configured to replace the first replaceable fluid supply unit, and determining a remaining amount of fluid in the second replaceable fluid supply unit by subtracting the determined amount of fluid consumed from a second nominal fluid volume of the second replaceable fluid supply unit.

11 Claims, 4 Drawing Sheets

IMAGE FORMING SYSTEMS AND METHODS THEREOF

BACKGROUND

Many image forming systems include a fluid ejector unit to eject fluid and an off-axis fluid supply unit to supply fluid to the fluid ejector unit. That is, the fluid ejector unit is separate from and not integral with the fluid supply unit. The fluid ejector unit and the fluid supply unit are replaceable to allow the respective units to be replaced, when necessary. For example, the fluid ejector unit may be replaced after its life expectancy has expired and the fluid supply unit may be replaced when the fluid contained therein is entirely consumed. The replacement frequency of the fluid supply unit greatly exceeds the replacement frequency of the fluid ejector unit.

BRIEF DESCRIPTION OF THE DRAWINGS

Exemplary non-limiting embodiments of the general inventive concept are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

Image forming systems may include periodically determining an amount of fluid remaining in a replaceable fluid supply unit used therein. Image forming systems such as inkjet printing systems having an off-axis replaceable fluid supply unit and fluid ejector unit generally provide predetermined information with the respective units. For example, manufacturers of replaceable fluid supply units may provide nominal fluid volumes corresponding to the volume of fluid provided in the respective fluid supply units and fluid densities corresponding to the fluid stored therein in memory thereof. The manufacturer may also provide nominal drop weight corresponding to the respective fluid ejector unit in memory thereof.

Certain image forming systems depend on manufacturer supplied information such as nominal drop weight to determine the remaining amount of fluid in a respective fluid supply unit. Generally, however, the nominal drop weight varies from an actual drop weight of the respective fluid ejector unit. For example, the manufacturer could have determined the nominal drop weight of only one fluid supply unit of a batch of fluid supply units. Or, the manufacturer may take an average of drop weights of several fluid supply units. Thus, the nominal drop weight provided by the manufacturer may correspond to a representative fluid ejector unit and not to the actual fluid ejector unit in which the nominal drop weight was provided. Further, characteristics of the fluid ejector unit can change over time and, thus, potentially further decrease the accuracy of the nominal drop weight with respect to the actual drop weight resulting in inaccuracies in the determination of the amount of fluid remaining in the respective fluid supply unit by the image forming systems. Thus, the present general inventive concept includes determining a correction factor to compensate for the inaccuracies of the nominal drop weight compared to the actual drop weight corresponding to the fluid ejector unit.

Figure 1A:
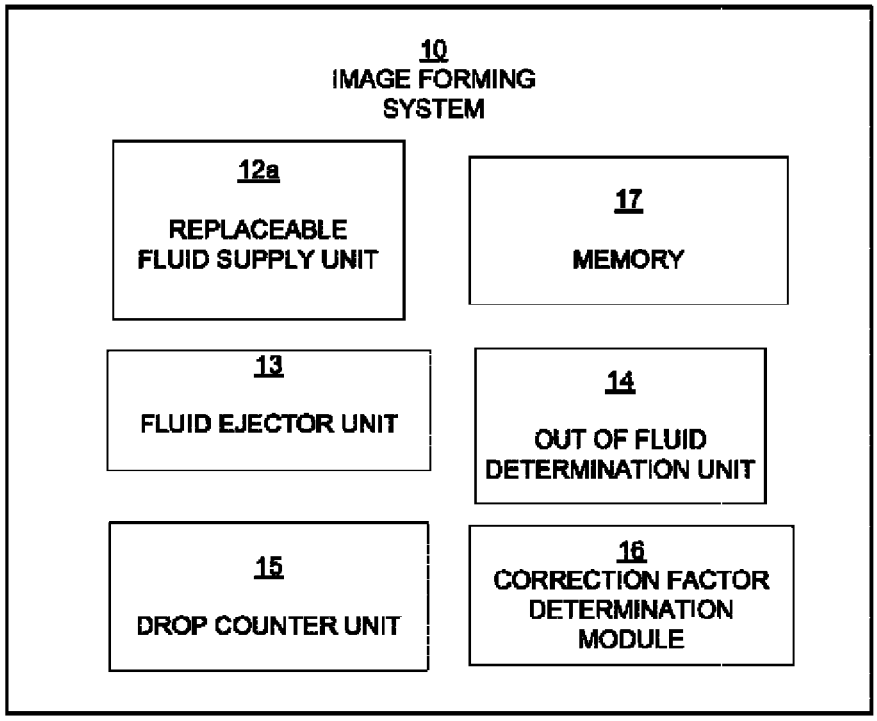
FIG. 1A is a block diagram illustrating an image forming system including a replaceable fluid supply unit according to an exemplary embodiment of the present general inventive concept.
Figure 1B:
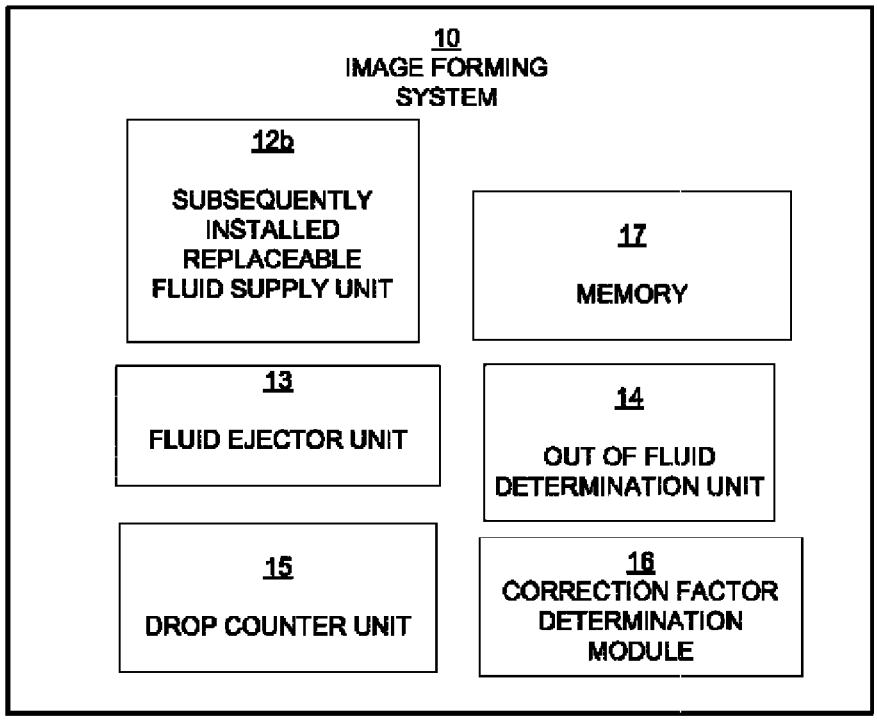
FIG. 1B is a block diagram illustrating the image forming system of FIG. 1A with a subsequently-installed replaceable fluid supply unit replacing the replaceable fluid supply unit according to an exemplary embodiment of the present general inventive concept.

FIG. 1A is a block diagram illustrating an image forming system including a replaceable fluid supply unit according to an exemplary embodiment of the present general inventive concept. FIG. 1B is a block diagram of an image forming system of FIG. 1A including a subsequently-installed replaceable fluid supply unit replacing the replaceable fluid supply unit according to an exemplary embodiment of the present general inventive concept. Referring to FIGS. 1A and 1B, in the present example, an image forming system 10 includes a fluid ejector unit 13 configured to eject drops of fluid. In an example, the drops of fluid are ejected on a substrate (not illustrated) such as a print media to form an image. The fluid ejector unit 13, for example, may be removably attached to the image forming system 10 to be replaced as needed. In the present example, the image forming system 10 is an inkjet printing system. In other examples, the image forming system 10 may be a digital copier, printer, bookmaking machine, facsimile machine, multi-function machine, or the like. The fluid ejector unit 13 may include a print head such as an inkjet print head.

Referring to FIGS. 1A and 1B, in the present example, the image forming system 10 also includes a replaceable fluid supply unit 12*a* configured to supply fluid to the fluid ejector unit 13. The fluid, for example, may include ink. The term ink is used generally herein, and encompasses any type of pigment or colorant such as toner, or other type of image forming material, and may be in a variety of forms such as liquid, semi-liquid, dry, powder, solid, semi-solid, or other forms, that is used in conjunction with image forming systems to form an image on a substrate. The image, for example, may include text, graphics, a combination of text and graphics, or the like. In the present example, the replaceable fluid supply unit 12*a* is an off-axis type and is removably attached to the image forming system 10 so that the replaceable fluid supply unit 12*a* can be replaced by a subsequently-installed replaceable fluid supply unit 12*b* when the fluid therein is entirely depleted. Thus, the subsequently-installed replaceable fluid supply unit 12*b* is configured to replace the replaceable fluid supply unit 12*a* in response to the detected out of fluid state corresponding to the replaceable fluid supply unit 12*a*. In an example, the replaceable fluid supply unit 12*a* is a replaceable ink cartridge containing ink therein.

In the present example, as illustrated in FIGS. 1A and 1B, the image forming system 10 also includes an out of fluid detection unit 14 configured to detect an out of fluid state of the replaceable fluid supply unit 12*a* and memory 17. In an example, the out of fluid detection unit 14 may include a pressure sensor to detect pressure or the lack of pressure due to a presence or absence of fluid in the replaceable fluid supply unit 12*a*. In other examples, the out of fluid detection unit 14 may include one or more sensors to detect an out of fluid state that are old and well-known. In an example, the memory 17 may include memory corresponding to the respective replaceable fluid supply units 12*a* and 12*b*, memory corresponding to the fluid ejector unit 13, local memory such as non-volatile and volatile memory, firmware and the like, and/or non-local memory in communication with the image forming system 10, for example, wirelessly and/or through a network.

In the present example, as illustrated in FIGS. 1A and 1B, the image forming system 10 also includes a drop counter unit 15 configured to periodically determine a current drop count by counting a number of drops ejected from the fluid ejector unit 13 and a total drop count by counting a total number of drops ejected from the fluid ejector unit 13 in response to the detected out of fluid state by the fluid supplied from the replaceable fluid supply unit 12*a*. In an example, the drop counter unit 15 may determine the number of drops ejected by the fluid ejector unit 13, for example, based on at least image forming data (not illustrated) input to the image forming system 10. For example, the drop counter unit 15 may be in the form of an application-specific integrated circuit (ASIC). In other examples, the drop counter unit 15 may include one or more sensors to detect ejected drops that are old and well-known.

In the present example, as illustrated in FIGS. 1A and 1B, the image forming system 10 also includes a correction factor determination module 16 configured to determine a correction factor including at least a volume ratio parameter of the replaceable fluid supply unit 12*a* to be used to determine an amount of remaining fluid of a subsequently-installed replaceable fluid supply unit 12*b*. In an example, the volume ratio parameter corresponds to a ratio of a nominal fluid volume and an estimated fluid volume of the replaceable fluid supply unit 12*a*. In the present example, the volume ratio parameter is obtained by dividing the estimated fluid volume into the nominal fluid volume. In other examples, the volume ratio parameter may be obtained by dividing the nominal fluid volume into the estimated fluid volume. The correction factor determination module 16 may be implemented in hardware, software, or in a combination of hardware and software. In other examples, the correction factor determination module 16 may be implemented in whole or in part as a computer program stored in the image forming system 10 and 20 locally or remotely, for example, in a server or a host computing device considered herein to be part of the image forming system 10 and 20.

The nominal fluid volume corresponding to the replaceable fluid supply unit 12*a* such as a predetermined nominal fluid volume and fluid density corresponding to the fluid in the replaceable fluid supply unit 12*a* such as a predetermined nominal fluid density, for example, may be provided in memory associated therewith such as a memory chip installed on the respective replaceable fluid supply unit 12*a* and 12*b* and provided by the manufacturer. Also, a nominal drop weight corresponding to the respective fluid ejector unit 13, for example, such as a predetermined nominal drop weight may be provided in memory associated therewith such as a memory chip installed on the respective fluid ejector unit 13 and provided by the manufacturer.

In an example, the estimated fluid volume is determined based on at least the total drop count determined by the drop counter unit 15. That is, the total number of drops ejected from the fluid ejector unit 13 in which the entire supply of fluid in the replaceable fluid supply unit 12*a* is consumed. Thus, when the fluid of the replaceable fluid supply unit 12*a* is entirely consumed, a subsequently-installed fluid supply unit 12*b* replaces the depleted fluid supply unit 12*a*. The replaced fluid supply unit 12*a* replaced by the subsequently-installed replaceable fluid supply unit 12*b* is designated as the previously-installed fluid supply unit 12*a*. In the present example, the estimated fluid volume of the respective replaceable fluid supply unit 12*a* and 12*b* is determined according to Equation 1 and the respective correction factor is determined according to Equation 2 below.

$$FLUID_VOL_{est}=(TL_NO_{drops})\times(CF_{pre})(DW)/FD, \quad \text{EQUATION (1)}$$

where: $CF_{pre}$ is a correction factor corresponding to a previously-installed replaceable fluid supply unit;

$FLUID_VOL_{est}$ is the estimated fluid volume corresponding to the replaceable fluid supply unit;

$TL_NO_{drops}$ is the total drop count corresponding to the total number of drops ejected from the fluid ejector unit by the fluid supplied from the replaceable fluid supply unit;

DW is a drop weight associated with the fluid ejector unit; and

FD is a fluid density corresponding to the fluid of the replaceable fluid supply unit.

$$CF=CF_{pre}(1+FLUID_VOL_{nom}/FLUID_VOL_{est})/2, \quad \text{EQUATION (2)}$$

where: $CF_{pre}$ is the correction factor corresponding to the previously-installed replaceable fluid supply unit;

CF is the correction factor corresponding to the replaceable fluid supply unit;

$FLUID_VOL_{nom}$ is the nominal fluid volume corresponding to the replaceable fluid supply unit; and $FLUID_VOL_{est}$ is the estimated fluid volume corresponding to the replaceable fluid supply unit.

In an example, when a first replaceable fluid supply unit 12*a* is initially used with a respective fluid ejector unit 13, the initial correction factor is set to one. Thus, in this example, the estimated fluid volume of the replaceable fluid supply unit 12*a* is determined according to EQUATION 3 and the correction factor is determined according to EQUATION 4 below.

$$FLUID_VOL_{est}=(TL_NO_{drops})\times(DW)/FD, \quad \text{EQUATION (3)}$$

where: $FLUID_VOL_{est}$ is the estimated fluid volume corresponding to the replaceable fluid supply unit;

$TL_NO_{drops}$ is the total drop count corresponding to the total number of drops ejected from the fluid ejector unit by the fluid supplied by the replaceable fluid supply unit;

DW is a drop weight associated with the fluid ejector unit; and

FD is a fluid density corresponding to the fluid of the replaceable fluid supply unit.

$$CF=(1+FLUID_VOL_{nom}/FLUID_VOL_{est})/2, \quad \text{EQUATION (4)}$$

where: CF is the correction factor corresponding to the replaceable fluid supply unit;

$FLUID_VOL_{nom}$ is the nominal fluid volume corresponding to the replaceable fluid supply unit; and $FLUID_VOL_{est}$ is the estimated fluid volume corresponding to the replaceable fluid supply unit.

Figure 2:
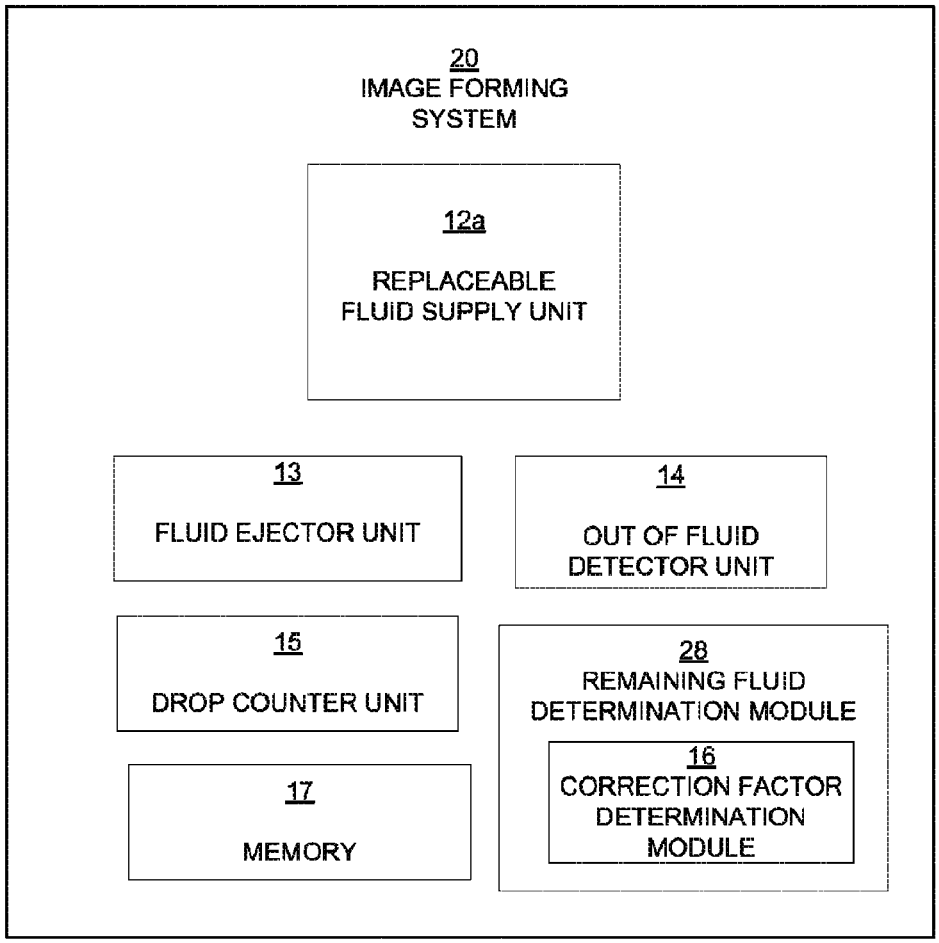
FIG. 2 is a block diagram of an image forming system including a remaining fluid determination module according to an exemplary embodiment of the present general inventive concept.

FIG. 2 is a block diagram illustrating an image forming system including a remaining fluid determination module according to an exemplary embodiment of the present general inventive concept. In the present example, the image forming system 20 illustrated in FIG. 2 corresponds to the image forming system 10 illustrated in FIG. 1A with the addition of a remaining fluid determination module 28. The remaining fluid determination module 28 is configured to determine an amount of remaining fluid in the respective replaceable fluid supply unit 12*a* and 12*b* by using a correction factor corresponding to a previously-installed replaceable fluid supply unit. In other examples, the remaining fluid determination module 28 is configured to determine the amount of remaining fluid in the respective replaceable fluid supply unit 12*a* and 12*b*, for example, by using an average of respective correction factors corresponding to at least two previously-installed replaceable fluid supply units.

Furthermore, in the present example, the respective correction factors corresponding to previously-installed replaceable fluid supply units may themselves have included information from even earlier-installed replaceable fluid supply units. That is, in the present example, except for the correction factor corresponding to the initially-installed replaceable fluid supply unit corresponding to a respective fluid ejector unit, each of the correction factors, which themselves may be used for subsequent determinations of future correction factors, are determined using information from previously-installed replaceable fluid supply units. Thus, respective subsequent correction factors determined by future iterations as illustrated, for example, by Equation 2, $CF=CF_{pre}(1+FLUID_VOL_{nom}/FLUID_VOL_{est})/2$, are continually fine-tuned.

The use of correction factors of previously-installed replaceable fluid supply units, for example, by the correction factor determination module 16 and the remaining fluid determination module 28 reduces the inaccuracies contributed to by the nominal drop weight of estimated fluid volume and remaining fluid volume. Also, in examples of the present general inventive concept, averaging multiple correction factors results in calculating the correction factor as a moving average and prevents, for example, a widely inaccurate determination of the remaining amount of fluid of a subsequently-installed replaceable fluid supply unit due to extremely inaccurate information being obtained from the latest replaceable fluid supply unit. For example, the volume ratio parameter, $FLUID_VOL_{nom}/FLUID_VOL_{est}$ ratio, corresponding to a particular replaceable fluid supply unit may be an aberration and not generally aligned with of vast majority of other previously-installed fluid supply units.

The remaining fluid determination module 28, for example, may also include the correction factor determination module 16. The remaining fluid determination module 28 may be implemented in hardware, software, or in a combination of hardware and software. In other examples, the remaining fluid determination module 28 may be implemented in whole or in part as a computer program stored in the image forming system 20 locally or remotely, for example, in a server or a host computing device considered herein to be part of the image forming system 20.

In the present example, the remaining fluid determination module 28 is configured to determine the amount of the fluid of the replaceable fluid supply unit 12*a* consumed by the fluid ejector unit 13 according to EQUATION 5 below.

$$FLUID_VOL_{used}=(CUR_NO_{drops})\times(DW)\times(CF_{pre})/FD, \quad \text{EQUATION 5}$$

where: $CF_{pre}$ is the correction factor corresponding to the previously-installed replaceable fluid supply unit;

$FLUID_VOL_{used}$ is the amount of the fluid of the replaceable fluid supply unit consumed by the fluid ejector unit;

$CUR_NO_{drops}$ is the current drop count corresponding to the number of drops ejected from the fluid ejector unit by the fluid supplied from the replaceable fluid supply unit;

DW is a drop weight associated with the fluid ejector unit; and

FD is a fluid density corresponding to the fluid of the replaceable fluid supply unit.

In an example, the remaining fluid determination module 28 determines the remaining amount of fluid in the replaceable fluid supply unit 12*a* by subtracting the determined amount of fluid consumed from a nominal fluid volume of the respective replaceable fluid supply unit 12*a*. The remaining fluid identification unit 28, for example, may also determine the amount of fluid remaining in units of volume and/or percentage of the amount of the fluid remaining with respect to the original amount of the fluid contained in the replaceable fluid supply unit 12*a*. In an example, the remaining fluid determination unit 28 may also periodically alert a user of the amount of fluid remaining in the replaceable fluid supply unit 12*a*.

The following example is provided for illustrative purposes. For example, assuming a nominal fluid volume of a replaceable fluid supply unit 12*a* is 130 ml (e.g., 0.13 liters), a predetermined fluid density of the fluid stored in the memory corresponding to the replaceable fluid supply unit 12*a* is 1000 kg/m$^3$(e.g., 1 kg/liter), a predetermined nominal drop weight of the fluid ejector unit 13 is 7 nanograms (e.g. $7\times10^{-12}$ kg), and $CF_{pre}$ is equal to 1 such as when a new replaceable fluid supply unit 12*a* is first used with the fluid ejector unit 13. In this example, at one point, the drop counter unit 14 determines that 10 billion drops have been ejected by the fluid ejector unit 13, for example, based on determining the number of drops necessary based on the image data received thereto. Thus, at this point, the current drop count of 10 billion is communicated to the remaining fluid determination module 28. At a subsequent point, the out of fluid detection unit 14 detects and communicates an out of fluid state to the drop counter unit 15. In this example, the drop counter unit 15 determines that 20 billion drops have been ejected by the fluid ejector unit 13 from the fluid in the replaceable fluid supply unit 12*a* at the time the out of fluid state is received. Thus, the total drop count is 20 billion.

In this example, therefore, according to EQUATION 5, $FLUID_VOL_{used}=(CUR_NO_{drops})\times(DW)\times(CF_{pre})/FD$, the correction factor determination unit 16 determines that the fluid volume consumed, $FLUID_VOL_{used}$, is calculated to be the following $(10\times10^9)\times(7\times10^{-9}\text{ grams})\times(1)/(10^3\text{ grams/l})=70\times10^{-3}\text{ l}=70\text{ ml}$. Since the nominal fluid volume is 130 ml, the calculated fluid volume used, 70 ml, is subtracted from nominal fluid volume, 130 ml, leaving a remaining volume of 60 ml or a remaining percentage of the original fluid supply unit 12*a* of 46.2% (e.g., 60 ml/130 ml).

In this example, therefore, according to EQUATION 1, $FLUID_VOL_{est}=(TL_NO_{drops})\times(CF_{pre})(DW)/FD$, the correction factor determination unit 16 determines at the subsequent point when the out of fluid state is received, that the estimated fluid volume, $FLUID_VOL_{est}$, is calculated to be the following $(20\times10^9)\times(1)(7\times10^{-9}\text{ grams})/(1\times10^3\text{ grams/l})=14\times10^{-2}\text{ l}=140\text{ ml}$.

In this example, therefore, according to EQUATION 2, $CF=CF_{pre}(1+FLUID_VOL_{nom}/FLUID_VOL_{est})/2$, the correction factor determination unit 16 determines after the estimated fluid volume is calculated, that the correction factor, CF, is calculated to be the following $(1)(1+(130\text{ ml}/140\text{ ml}))/2=(1+0.929)=0.965$. Thus, the correction factor, CF, corresponding to the replaceable fluid supply unit 12*a* is 0.965 which is also the correction factor, $CF_{pre}$, used with respect to the subsequently-installed replaceable fluid supply unit 12*b*.

Figure 3A:
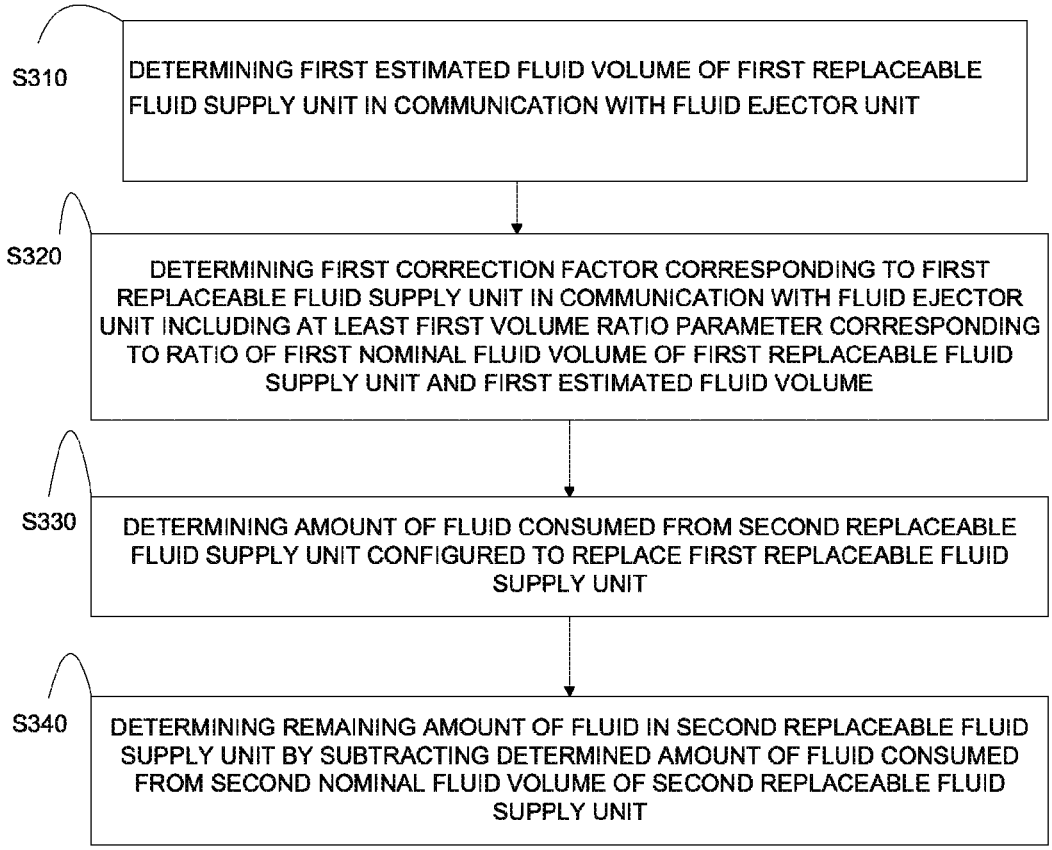
FIG. 3A is a flowchart illustrating a method to determine an amount of remaining fluid in a replaceable fluid supply unit according to an exemplary embodiment of the present general inventive concept.

FIG. 3A is a flowchart illustrating a method to determine an amount of remaining fluid in a replaceable fluid supply unit according to an exemplary embodiment of the present general inventive concept. Referring to FIGS. 3A, 1A and 1B, in block S310, a first estimated fluid volume of a first replaceable fluid supply unit in communication with a fluid ejector unit is determined. In block S320, a first correction factor corresponding to the first replaceable fluid supply unit in communication with the fluid ejector unit including at least a first volume ratio parameter corresponding to a ratio of a first nominal fluid volume of the first replaceable fluid supply unit and the first estimated fluid volume is determined. In block S330, an amount of fluid consumed from a second replaceable fluid supply unit configured to replace the first replaceable fluid supply unit is determined. In block S340, a remaining amount of fluid in the second replaceable fluid supply unit is determined by subtracting the determined amount of fluid consumed from a second nominal fluid volume of the second replaceable fluid supply unit.

In an example, the first estimated fluid volume of a first replaceable fluid supply unit in communication with a fluid ejector unit may be determined by detecting an out of fluid state of the first replaceable fluid supply unit, determining a total drop count of a number of drops ejected from the fluid ejector unit by the fluid supplied from the first replaceable fluid supply unit in response to the detected out of fluid state, and determining the first estimated fluid volume corresponding to the first replaceable fluid supply unit according to EQUATION 6 below.

$$FLUID_VOL1_{est}=(TL_NO1_{drops})\times(DW)/FD1, \quad \text{EQUATION 6}$$

where: $FLUID_VOL1_{est}$ is the estimated fluid volume corresponding to the first replaceable fluid supply unit;

$TL_NO1_{drops}$ is the total drop count corresponding to the total number of drops ejected from the fluid ejector unit by the fluid supplied from the first replaceable fluid supply unit;

DW is a drop weight associated with the fluid ejector unit; and

FD1 is a fluid density corresponding to the fluid of the first replaceable fluid supply unit.

In an example, a first correction factor corresponding to a first replaceable fluid supply unit in communication with the fluid ejector unit is determined by detecting the out of fluid state of the first replaceable fluid supply unit, and determining the first correction factor according to EQUATION 7 below.

$$CF1=(1+FLUID_VOL1_{nom}/FLUID_VOL1_{est})/2, \quad \text{EQUATION 7}$$

where: CF1 is the first correction factor corresponding to the first replaceable fluid supply unit;

$FLUID_VOL1_{nom}$ is the first nominal fluid volume corresponding to the first replaceable fluid supply unit; and $FLUID_VOL1_{est}$ is the first estimated fluid volume corresponding to the first replaceable fluid supply unit.

In an example, the amount of fluid consumed from a second replaceable fluid supply unit is determined by determining a current drop count by counting a number of drops ejected from the fluid ejector unit by the fluid supplied from the second replaceable fluid supply unit, and determining the amount of fluid consumed from the second replaceable fluid supply unit according to EQUATION 8 below.

$$FLUID_VOL2_{used}=(CUR_NO2_{drops})\times(DW)\times(CF1)/FD2, \quad \text{EQUATION 8}$$

where: CF1 is the first correction factor corresponding to the first replaceable fluid supply unit;

$FLUID_VOL2_{used}$ is the amount of the fluid of the second replaceable fluid supply unit consumed by the fluid ejector unit;

$CUR_NO2_{drops}$ is the current drop count corresponding to the number of drops ejected from the fluid ejector unit by fluid supplied from the second replaceable fluid supply unit;

DW is the drop weight associated with the fluid ejector unit; and

FD2 is a second fluid density corresponding to the fluid of the second replaceable fluid supply unit.

Figure 3B:
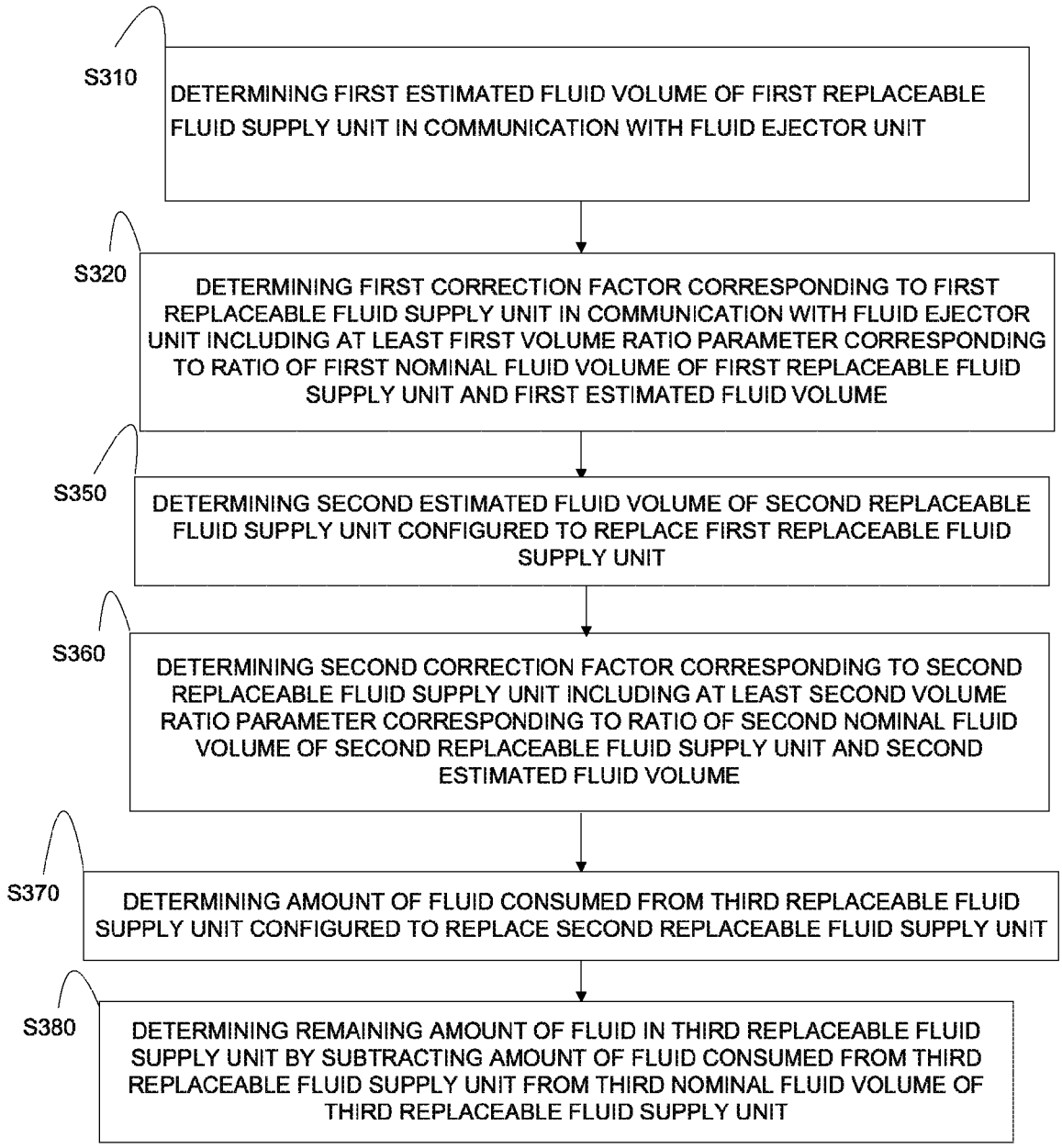
FIG. 3B is a flowchart illustrating a method to determine an amount of remaining fluid in a replaceable fluid supply unit according to an exemplary embodiment of the present general inventive concept.

FIG. 3B is a flowchart illustrating a method to determine an amount of remaining fluid in a replaceable fluid supply unit according to an exemplary embodiment of the present general inventive concept. Referring to FIGS. 3B, 1A and 1B, in block S310, a first estimated fluid volume of a first replaceable fluid supply unit in communication with a fluid ejector unit is determined as previously described with reference to FIG. 3A and Equation 3. In block S320, a first correction factor corresponding to the first replaceable fluid supply unit in communication with the fluid ejector unit including at least a first volume ratio parameter corresponding to a ratio of a first nominal fluid volume of the first replaceable fluid supply unit and the first estimated fluid volume is determined as previously described with reference to FIG. 3A and Equation 4. In block S350, a second estimated fluid volume of a second replaceable fluid supply unit configured to replace the first replaceable fluid supply unit is determined. In block S360, a second correction factor corresponding to the second replaceable fluid supply unit including at least a second volume ratio parameter corresponding to a ratio of a second nominal fluid volume of the second replaceable fluid supply unit and the second estimated fluid volume is determined. In block S370, an amount of fluid consumed from a third replaceable fluid supply unit configured to replace the second replaceable fluid supply unit is determined. In block S380, a remaining amount of fluid in the third replaceable fluid supply unit is determined by subtracting the amount of fluid consumed from the third replaceable fluid supply unit from a third nominal fluid volume of the third replaceable fluid supply unit.

In an example, the second estimated fluid volume of a second replaceable fluid supply unit is determined by detecting an out of fluid state of the second replaceable fluid supply unit, determining a total drop count of a number of drops ejected from the fluid ejector unit by the fluid supplied from the second replaceable fluid supply unit in response to the detected out of fluid state, and determining the second estimated fluid volume corresponding to the second replaceable fluid supply unit according to EQUATION 9 below.

$$FLUID_VOL2_{est}=(TL_NO2_{drops})\times(CF1)(DW)/FD2, \quad \text{EQUATION 9}$$

where: CF1 is the first correction factor corresponding to the first replaceable fluid supply unit;

$FLUID_VOL2_{est}$ is the estimated second fluid volume corresponding to the second replaceable fluid supply unit;

$TL_NO2_{drops}$ is the total drop count corresponding to the total number of drops ejected from the fluid ejector unit by the fluid supplied from the second replaceable fluid supply unit;

DW is the drop weight associated with the fluid ejector unit; and

FD2 is a fluid density corresponding to the fluid of the second replaceable fluid ink supply unit.

In an example, the second correction factor corresponding to a second replaceable fluid supply unit is determined by detecting the out of fluid state of the second replaceable fluid supply unit, and determining the second correction factor according to EQUATION 10 below.

$$CF2=CF1(1+FLUID_VOL2_{nom}/FLUID_VOL2_{est})/2, \quad \text{EQUATION 10}$$

where: CF2 is the second correction factor corresponding to the second replaceable fluid supply unit;

CF1 is the first correction factor corresponding to the first replaceable fluid supply unit;

$FLUID_VOL2_{nom}$ is the second nominal fluid volume corresponding to the second replaceable fluid supply unit; and $FLUID_VOL2_{est}$ is the second estimated fluid volume corresponding to the second replaceable fluid supply unit.

In an example, the amount of fluid consumed from a third replaceable fluid supply unit is determined by determining a current drop count by counting a number of drops ejected from the fluid ejector unit by the fluid supplied from the third replaceable fluid supply unit, and determining the amount of fluid consumed from the third replaceable fluid supply unit according to EQUATION 11 below.

$$FLUID_VOL3_{used}=(CUR_NO3_{drops})\times(DW)\times(CF2)/FD3, \quad \text{EQUATION 11}$$

where: $FLUID_VOL3_{used}$ is the amount of the fluid of the third replaceable fluid supply unit consumed by the fluid ejector unit;

$CUR_NO3_{drops}$ is the current drop count corresponding to the number of drops ejected from the fluid ejector unit by fluid supplied from the third replaceable fluid supply unit;

DW is the drop weight associated with the fluid ejector unit;

CF2 is the second correction factor corresponding to the second replaceable fluid supply unit; and FD3 is a fluid density corresponding to the fluid of the third replaceable fluid supply unit.

It is to be understood that the flowcharts of FIGS. 3A and 3B illustrate an architecture, functionality, and operation of exemplary embodiments of the present general inventive concept. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowcharts of FIGS. 3A and 3B illustrate a specific order of execution, the order of execution may differ from that which is depicted. For example, the order of execution of two or more blocks may be scrambled relative to the order illustrated. Also, two or more blocks illustrated in succession in FIGS. 3A and 3B may be executed concurrently or with partial concurrence. All such variations are within the scope of the present general inventive concept.

Also, the present general inventive concept can be embodied in any computer-readable medium for use by or in connection with an instruction-execution system, apparatus or device such as a computer/processor based system, processor-containing system or other system that can fetch the instructions from the instruction-execution system, apparatus or device, and execute the instructions contained therein. In the context of this disclosure, a "computer-readable medium" can be any means that can store, communicate, propagate or transport a program for use by or in connection with the instruction-execution system, apparatus or device. The computer-readable medium can include any one of many physical media such as, for example, electronic, magnetic, optical, electromagnetic, infrared, or semiconductor media. More specific examples of a suitable computer-readable medium would include, but are not limited to, a portable magnetic computer diskette such as floppy diskettes or hard drives, a random access memory (RAM), a read-only memory (ROM), an erasable programmable read-only memory, or a portable compact disc. It is to be understood that the computer-readable medium could even be paper or another suitable medium upon which the program is printed, as the program can be electronically captured, via, for instance, optical scanning of the paper or other medium, then compiled, interpreted or otherwise processed in a single manner, if necessary, and then stored in a computer memory.

Those skilled in the art will understand that various exemplary embodiments of the present general inventive concept can be implemented in hardware, software, firmware or combinations thereof. Separate embodiments of the present general inventive concept can be implemented using a combination of hardware and software or firmware that is stored in memory and executed by a suitable instruction-execution system. If implemented solely in hardware, as in an alternative embodiment, the present general inventive concept can be separately implemented with any or a combination of technologies which are well known in the art (for example, discrete-logic circuits, application-specific integrated circuits (ASICs), programmable-gate arrays (PGAs), field-programmable gate arrays (FPGAs), and/or other later developed technologies. In other embodiments, the present general inventive concept can be implemented in a combination of software and data executed and stored under the control of a computing device.

Once given the above disclosure, many other features, modifications or improvements will become apparent to the skilled artisan. Such features, modifications or improvements are, therefore, considered to be a part of the general inventive concept, the scope of which is to be determined by the following claims.

What is claimed is:

1. An image forming system, comprising:

a fluid ejector unit configured to eject drops of fluid;

a replaceable fluid supply unit configured to supply fluid to the fluid ejector unit;

an out of fluid detection unit configured to detect an out of fluid state of the replaceable fluid supply unit;

a drop counter unit configured to determine a total drop count by counting a total number of drops ejected from the fluid ejector unit in response to the detected out of fluid state; and a correction factor determination module configured to determine a correction factor including at least a volume ratio parameter of the replaceable fluid supply unit to be used to determine an amount of remaining fluid of a subsequently-installed replaceable fluid supply unit such that the volume ratio parameter corresponds to a ratio of a nominal fluid volume and an estimated fluid volume of the replaceable fluid supply unit and the estimated fluid volume is determined based on at least the determined total drop count the subsequently-installed replaceable fluid supply unit is configured to replace the replaceable fluid supply unit in response to the detected out of fluid state, the correction factor is determined according to the following (CF) equation CF=(1+FLUID_VOLnom/FLUID_VOLest)/2, and the estimated fluid volume of the replaceable fluid supply unit is determined according to the following (FLUID_VOLest) equation FLUID_VOLest=(TL_NOdrops)×(DW)/FD; and wherein:

FLUID_VOLest is the estimated fluid volume corresponding to the replaceable fluid supply unit;

TL_NOdrops is the total drop count corresponding to the total number of drops ejected from the fluid ejector unit by the fluid supplied by the replaceable fluid supply unit:

DW is a drop weight associated with the fluid ejector unit; and

FD is a fluid density corresponding to the fluid of the replaceable fluid supply unit; and wherein:

CF is the correction factor corresponding to the replaceable fluid supply unit;

FLUID_VOLnom is the nominal fluid volume corresponding to the replaceable fluid supply unit; and FLUID_VOLest is the estimated fluid volume corresponding to the replaceable fluid supply unit.

2. The system according to claim 1, further comprising:

a remaining fluid determination module configured to determine an amount of remaining fluid in the replaceable fluid supply unit by using a correction factor corresponding to a previously-installed replaceable fluid supply unit.

3. The system according to claim 2, wherein the remaining fluid determination module is configured to determine the amount of remaining fluid in the replaceable fluid supply unit by using an average of respective correction factors corresponding to at least two previously-installed replaceable fluid supply units.

4. The system according to claim 3, wherein the drop counter unit is configured to determine a current drop count by counting a number of drops ejected from the fluid ejector unit by the fluid supplied from the replaceable fluid supply unit.

5. The system according to claim 4, wherein the remaining fluid determination module is configured to determine the amount of the fluid of the replaceable fluid supply unit consumed by the fluid ejector unit according to the following equation:

$$FLUID_VOLused=(CUR_NOdrops)\times(DW)\times(CFpre)/FD,$$

where: CFpre is the correction factor corresponding to the previously-installed replaceable fluid supply unit;

FLUID_VOLused is the amount of the fluid of the replaceable fluid supply unit consumed by the fluid ejector unit;

CUR_NOdrops is the current drop count corresponding to the number of drops ejected from the fluid ejector unit by the fluid supplied from the replaceable fluid supply unit;

DW is a drop weight associated with the fluid ejector unit; and

FD is a fluid density corresponding to the fluid of the replaceable fluid supply unit.

6. The system according to claim 5, wherein the drop weight comprises a predetermined nominal drop weight corresponding to the fluid ejector unit and stored in memory corresponding to the fluid ejector unit and the fluid density comprises a predetermined fluid density corresponding to the respective fluid and stored in memory corresponding to the replaceable fluid supply unit.

7. A method to determine an amount of remaining fluid in a replaceable fluid supply unit, the method comprising:

determining a first estimated fluid volume of a first replaceable fluid supply unit in communication with a fluid ejector unit by:

detecting an out of fluid state of the first replaceable fluid supply unit;

determining a total drop count of a number of drops ejected from the fluid ejector unit by the fluid supplied from the first replaceable fluid supply unit in response to the detected out of fluid state; and determining the first estimated fluid volume corresponding to the first replaceable fluid supply unit according to the following (FLUID_VOL1est) equation FLUID_VOL1est=(TL_NO1drops)×(DW)/FD1; and determining a first correction factor corresponding to the first replaceable fluid supply unit in communication with the fluid ejector unit including at least a first volume ratio parameter corresponding to a ratio of a first nominal fluid volume of the first replaceable fluid supply unit and the first estimated fluid volume by:

detecting the out of fluid state of the first replaceable fluid supply unit; and determining the first correction factor according to the following (CF1) equation CF1=(1+FLUID_VOL1nom/FLUID_VOL1est)/2; and determining an amount of fluid consumed from a second replaceable fluid supply unit configured to replace the first replaceable fluid supply unit; and determining a remaining amount of fluid in the second replaceable fluid supply unit by subtracting the determined amount of fluid consumed from a second nominal fluid volume of the second replaceable fluid supply unit; and wherein:

FLUID_VOL1est is the estimated fluid volume corresponding to the first replaceable fluid supply unit;

TL_NO1drops is the total drop count corresponding to the total number of drops ejected from the fluid ejector unit by the fluid supplied from the first replaceable fluid supply unit;

DW is a drop weight associated with the fluid ejector unit; and

FD1 is a fluid density corresponding to the fluid of the first replaceable fluid supply unit; and wherein:

CF1 is the first correction factor corresponding to the first replaceable fluid supply unit;

FLUID_VOL1nom is the first nominal fluid volume corresponding to the first replaceable fluid supply unit; and FLUID_VOL1est is the first estimated fluid volume corresponding to the first replaceable fluid supply unit.

8. The method according to claim 7, wherein determining an amount of fluid consumed from a second replaceable fluid supply unit comprises:

determining a current drop count by counting a number of drops ejected from the fluid ejector unit by the fluid supplied from the second replaceable fluid supply unit; and determining the amount of fluid consumed from the second replaceable fluid supply unit according to the following equation:

$$FLUID_VOL2used=(CUR_NO2drops)\times(DW)\times(CF1)/FD2,$$

where: CF1 is the first correction factor corresponding to the first replaceable fluid supply unit;

FLUID _VOL2used is the amount of the fluid of the second replaceable fluid supply unit consumed by the fluid ejector unit;

CUR_NO2drops is the current drop count corresponding to the number of drops ejected from the fluid ejector unit by fluid supplied from the second replaceable fluid supply unit;

DW is the drop weight associated with the fluid ejector unit; and

FD2 is a second fluid density corresponding to the fluid of the second replaceable fluid supply unit.

9. A method to determine an amount of remaining fluid in a replaceable fluid supply unit, the method comprising:

determining a first estimated fluid volume of a first replaceable fluid supply unit in communication with a fluid ejector unit;

determining a first correction factor corresponding to the first replaceable fluid supply unit in communication with the fluid ejector unit including at least a first volume ratio parameter corresponding to a ratio of a first nominal fluid volume of the first replaceable fluid supply unit and the first estimated fluid volume;

determining a second estimated fluid volume of a second replaceable fluid supply unit configured to replace the first replaceable fluid supply unit by:

detecting an out of fluid state of the second replaceable fluid supply unit;

determining a total drop count of a number of drops ejected from the fluid ejector unit by the fluid supplied from the second replaceable fluid supply unit in response to the detected out of fluid state; and determining the second estimated fluid volume corresponding to the second replaceable fluid supply unit according to the following (FLUID_VOL2est) equation FLUID_VOL2est=(TL_NO2drops)×(CF1)(DW)/FD2; and determining a second correction factor corresponding to the second replaceable fluid supply unit including at least a second volume ratio parameter corresponding to a ratio of a second nominal fluid volume of the second replaceable fluid supply unit and the second estimated fluid volume by:

detecting the out of fluid state of the second replaceable fluid supply unit; and determining the second correction factor according to the (CF2) following equation CF2=CF1(1+FLUID_VOL2nom/FLUID_VOL2est)/2; and determining an amount of fluid consumed from a third replaceable fluid supply unit configured to replace the second replaceable fluid supply unit; and determining a remaining amount of fluid in the third replaceable fluid supply unit by subtracting the amount of fluid consumed from the third replaceable fluid supply unit from a third nominal fluid volume of the third replaceable fluid supply unit and wherein:

CF1 is the first correction factor corresponding to the first replaceable fluid supply unit;

FLUID_VOL2est is the estimated second fluid volume corresponding to the second replaceable fluid supply unit;

TL_NO2drops is the total drop count corresponding to the total number of drops ejected from the fluid ejector unit by the fluid supplied from the second replaceable fluid supply unit;

DW is the drop weight associated with the fluid ejector unit; and

FD2 is a fluid density corresponding to the fluid of the second replaceable fluid supply unit; and wherein:

CF2 is the second correction factor corresponding to the second replaceable fluid supply unit;

CF1 is the first correction factor corresponding to the first replaceable fluid supply unit;

FLUID_VOL2nom is the second nominal fluid volume corresponding to the second replaceable fluid supply unit; and FLUID_VOL2est is the second estimated fluid volume corresponding to the second replaceable fluid supply unit.

10. The method according to claim 9, wherein determining an amount of fluid consumed from a third replaceable fluid supply unit comprises:

determining a current drop count by counting a number of drops ejected from the fluid ejector unit by the fluid supplied from the third replaceable fluid supply unit; and determining the amount of fluid consumed from the third replaceable fluid supply unit according to the following equation:

FLUID_VOL3used=(CUR_NO3drops)×(DW)×(CF2)/FD3, where: FLUID_VOL3used is the amount of the fluid of the third replaceable fluid supply unit consumed by the fluid ejector unit;

CUR_NO3drops is the current drop count corresponding to the number of drops ejected from the fluid ejector unit by fluid supplied from the third replaceable fluid supply unit;

DW is the drop weight associated with the fluid ejector unit;

CF2 is the second correction factor corresponding to the second replaceable fluid supply unit; and FD3 is a fluid density corresponding to the fluid of the third replaceable fluid supply unit.

11. An image forming system, comprising:

a fluid ejector unit configured to eject drops of fluid;

a replaceable fluid supply unit configured to supply fluid to the fluid ejector unit;

an out of fluid detection unit configured to detect an out of fluid state of the replaceable fluid supply unit;

a drop counter unit configured to determine a total drop count by counting a total number of drops ejected from the fluid ejector unit in response to the detected out of fluid state; and a correction factor determination module configured to determine a correction factor including at least a volume ratio parameter of the replaceable fluid supply unit to be used to determine an amount of remaining fluid of a subsequently-installed replaceable fluid supply unit and the correction factor is determined according to the following (CF) equation CF=CFpre(1+FLUID_VOLnom/FLUID_VOLest)/2 such that the volume ratio parameter corresponds to a ratio of a nominal fluid volume and an estimated fluid volume of the replaceable fluid supply unit and the estimated fluid volume is determined based on at least the determined total drop count and the estimated fluid volume of the replaceable fluid supply unit is determined according to the following (FLUID_VOLest) equation FLUID_VOLest=(TL_NOdrops)×(CFpre)(DW)/FD such that the subsequently-installed replaceable fluid supply unit is configured to replace the replaceable fluid supply unit in response to the detected out of fluid state; and wherein:

CFpre is a correction factor corresponding to a previously-installed replaceable fluid supply unit;

FLUID_VOLest is the estimated fluid volume corresponding to the replaceable fluid supply unit;

TL_NOdrops is the total drop count corresponding to the total number of drops ejected from the fluid ejector unit by the fluid supplied from the replaceable fluid supply unit;

DW is a drop weight associated with the fluid ejector unit; and

FD is a fluid density corresponding to the fluid of the replaceable fluid supply unit; and wherein:

CFpre is the correction factor corresponding to the previously-installed replaceable fluid supply unit;

CF is the correction factor corresponding to the replaceable fluid supply unit;

FLUID_VOLnom is the nominal fluid volume corresponding to the replaceable fluid supply unit; and FLUID_VOLest is the estimated fluid volume corresponding to the replaceable fluid supply unit.

* * * * *

UNITED STATES PATENT AND TRADEMARK OFFICE

CERTIFICATE OF CORRECTION

PATENT NO. : 8,246,132 B2
APPLICATION NO. : 12/703332
DATED : August 21, 2012
INVENTOR(S) : Angel Martinez et al.

It is certified that error appears in the above-identified patent and that said Letters Patent is hereby corrected as shown below:

In the Claims:

In column 10, line 63, in Claim 1, delete “unit:” and insert -- unit; --, therefor.

Signed and Sealed this
Seventh Day of May, 2013

Teresa Stanek Rea
*Acting Director of the United States Patent and Trademark Office*